US005447192A

United States Patent [19]

Woerner et al.

[11] Patent Number: 5,447,192

[45] Date of Patent: Sep. 5, 1995

[54] HEAT EXCHANGER ASSEMBLY WITH REINFORCEMENT AND METHOD FOR MAKING SAME

[75] Inventors: Gerald T. Woerner; James W. B. Lu; Norman F. Costello, all of Mt. Pleasant, S.C.

[73] Assignee: Behr Heat Transfer Systems, Inc., Charleston, S.C.

[21] Appl. No.: 273,954

[22] Filed: Jul. 12, 1994

[51] Int. Cl.[6] ..... F28F 9/007

[52] U.S. Cl. ..... 165/81; 165/149

[58] Field of Search ..... 165/149, 173, 67, 81, 165/82; 180/68.4, 68.6

[56] References Cited

U.S. PATENT DOCUMENTS

| | | | |
|---|---|---|---|
| 2,506,051 | 5/1950 | Young | 165/149 X |
| 2,935,291 | 4/1960 | Huggins | 165/149 |
| 3,165,151 | 1/1965 | Astrup et al. | 165/149 X |
| 3,228,461 | 1/1966 | Seekins | 165/81 |
| 3,939,908 | 2/1976 | Chartet | 165/149 |
| 3,960,210 | 6/1976 | Chartet | 165/149 |
| 4,534,407 | 8/1985 | Lardner | 165/81 |
| 5,257,662 | 11/1993 | Osborn | 165/173 |

FOREIGN PATENT DOCUMENTS

| | | | |
|---|---|---|---|
| 3916788 | 2/1990 | Germany | 165/149 |
| 148510 | 9/1977 | United Kingdom | 165/149 |

*Primary Examiner*—Martin P. Schwadron
*Assistant Examiner*—L. R. Leo
*Attorney, Agent, or Firm*—Howard & Howard

[57] ABSTRACT

A heat exchanger assembly (10) includes a pair of manifolds (12, 14) with a core member (20) connected therebetween. The core member (20) includes a plurality of fluid tubes (16) extending between the manifolds (12, 14) in fluid communication therewith, a plurality of air fins (18) connected between the fluid tubes (16), and a pair of side support members (22) are joined to the manifolds (12, 14) at the outermost sides thereof. Reinforcement straps (50) are connected at each corner of the assembly (10) between the side support members (22) and the manifolds (12, 14) to reinforce the joints of the assembly (10).

4 Claims, 1 Drawing Sheet

HEAT EXCHANGER ASSEMBLY WITH REINFORCEMENT AND METHOD FOR MAKING SAME

TECHNICAL FIELD

The subject invention relates to heat exchangers of the type having a pair of manifolds connected to a core member, the core member including parallel fluid tubes and air fins connected between manifolds, and the reinforcement of the connection between the manifolds and the core member.

BACKGROUND ART

Commonly known in the art are heat exchangers used in connection with an automotive vehicle for cooling the engine of the vehicle. The heat exchanger generally comprises an upper and lower manifold providing fluid reservoirs for the inlet and outlet of engine fluid to the heat exchanger, i.e., coolant. A plurality of coolant or fluid tubes extend between the manifolds providing fluid communication therebetween. These types of heat exchangers are liquid to air because liquid passes through the tanks and tubes while is air is passed external and between the tubes for cooling the fluid therein.

There are also air to air heat exchangers wherein air is passed within the tubes and air is passed externally thereover for heat exchange. This type of heat exchanger may be used in turbo charged engines wherein heat exchangers are routinely used for cooling compressed "charged" air from a turbo charger, on route to the cylinders for combustion.

Air fins are connected between fluid tubes for enhancing heat exchange between the external air and fluid tubes. The manifolds include a tank portion and header which are welded to one another. The core comprising the fluid tubes and air fins are soldered to the header. Generally, the core includes side support members connected on the sides thereof between the manifolds for providing additional support to the core.

U.S. Pat. No. 5,257,662, issued Nov. 2, 1993 in the name of Osborn illustrates a typical heat exchanger assembly including a pair of manifolds with headers and a core member connected between the headers. The core member commonly includes a plurality of fluid tubes extending between the tanks to provide fluid communicating therebetween, a plurality of fins connected to the fluid tubes for enhancing heat exchange, and structural side members connected between the tanks at the outer sides of the core member.

The heated fluid communicated between the manifolds and fluid tubes cause thermal expansion of the members. Ambient cooling air passes through and around the cooling fins and is disbursed about the fluid tubes, thereby allowing the fluid to release a majority of its thermal energy. The high amount of thermal energy released causes large thermal expansion of the fluid tubes, air fins, header and side support members. The large thermal expansion causes shear stresses between the tank portion and header and coolant tubes. Significant shear stresses are caused from the differences between the thermal expansions of the fluid tubes and the side support members. Over time, the shear stresses cause cracking and fatigue between the joints, resulting in leaks, lost pressure, and inefficient heat transfer characteristics. Therefore, it is desirable to reduce the shear stresses while allowing normal expansion to continue.

Various heat exchangers have utilized external components added to the heat exchangers, namely for mounting purposes. One such heat exchanger is disclosed in U.S. Pat. No. 2,506,051, issued May 2, 1950 in the name of Young. The heat exchanger of Young discloses use of a U-shaped bracket which is connected lengthwise along one of the tanks and extends and is connected to side support members extending along the core. This U-shaped member is utilized for mounting and supporting the heat exchanger. There is no disclosure of reducing the thermal stresses. The U-bracket prevents uninhibited thermal expansion of the manifolds and core.

SUMMARY OF THE INVENTION

The invention includes a heat exchanger assembly comprising a manifold having an opening conveying fluid therethrough and including first and second distal ends, and a core member connected to the manifold between the first and second distal ends for conveying fluid from the manifold through the core for heat exchange. The core member includes a plurality of fluid tubes connected to the manifold and extending therefrom for communication of fluid between the manifold and the fluid tubes, a plurality of fins connected between the fluid tubes for enhancing heat exchange with fluid within the tubes, and side support members extending from the manifold at the first and second distal ends for supporting the fluid tubes and fins therebetween. The side support members each have first ends adjacent the distal ends of the manifold. The assembly is characterized by including reinforcement straps fixedly secured to and interconnecting the distal ends of the manifold and the first ends of the side support members for allowing uninhibited thermal expansion of the manifold and the core between the reinforcement straps and for providing reinforcement of the connection of the core member to the manifold.

The invention is also directed toward a method of making a heat exchanger which includes the steps of: forming a tank with distal ends and having an opening therethrough for conveying fluids; forming a header adapted to be connected to the tank to form a closed manifold and having a plurality of apertures therethrough; forming a core member including a plurality of spaced fluid tubes with fins between adjacent fluid tubes and at least one side support member connected parallel with the fluid tubes at an outer side of the core member; assembling the header to the core member by placing ends of the fluid tubes in the apertures with the header adjacent the side support members and soldering the header to the fluid tubes; and welding a structural reinforcement strap to the distal end of the tank and an end of the side support member.

The invention allows both the manifolds and side support members to expand from thermal effects while reinforcing the joint or connection therebetween.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
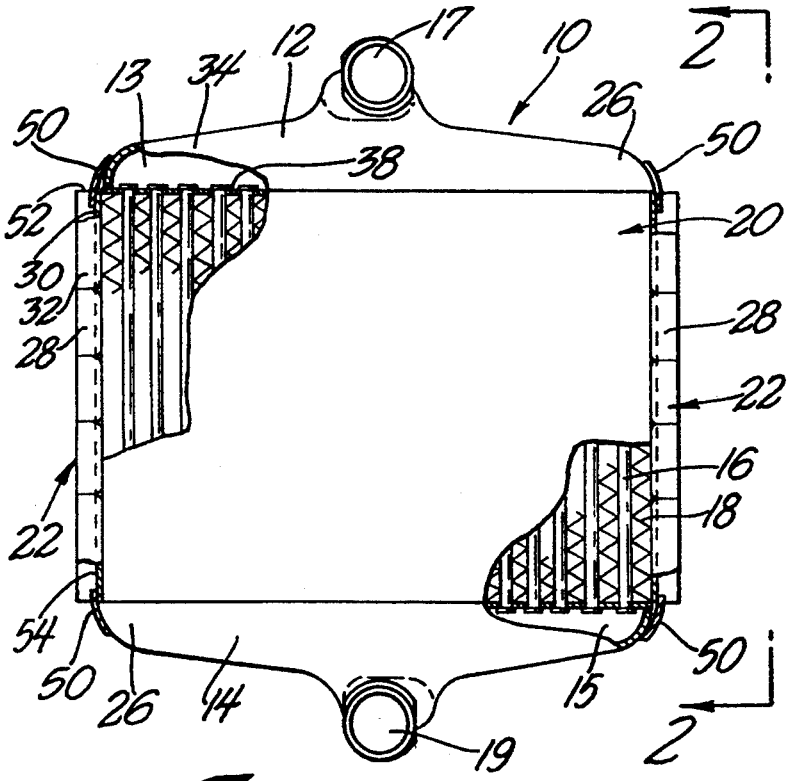
FIG. 1 is a partially broken away front elevational view of a heat exchanger according to the subject invention.
Figure 2:
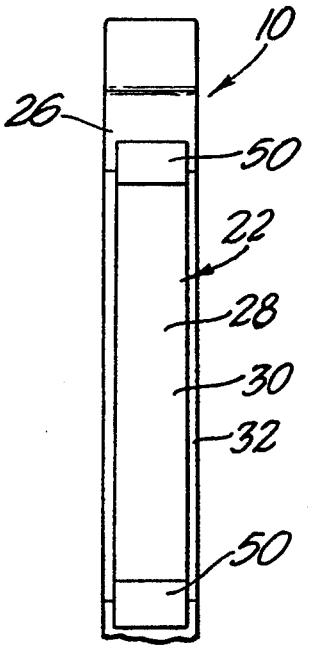
FIG. 2 is a side view of the heat exchanger taken along lines 2—2 of FIG. 1.

A heat exchanger assembly of the type commonly used in connection with an automotive vehicle is generally illustrated at 10 in FIG. 1. The heat exchanger assembly 10 comprises upper 12 and lower 14 manifolds providing fluid reservoirs 13, 15. The upper manifold 12 generally includes a fluid inlet 17 for communicating fluid into the assembly 10, and the lower manifold 14 includes a fluid outlet 19 for circulating the cooled fluid back to the vehicle. The placement of the inlet 17 and outlet 19 may be varied, as is commonly known in the art.

A core member 20 is connected between the manifolds 12, 14 for conveying fluid between the manifolds 12, 14 and through the assembly 10. The core member comprises a plurality of fluid tubes 16 and fins 18. The plurality of fluid tubes 16 extend between the manifolds 12, 14 for communicating either a liquid or gas through the heat exchange assembly 10. A plurality of external air or cooling fins 18 extend between the fluid tubes 16 in either air-to-air or liquid-to-air exchangers. The fins 18 are positioned between adjacent fluid tubes 16 for directing the cooling air about the outer portions of the fluid tubes 16. Furthermore, the core member 20 includes a pair of side support members 22 extending between the manifolds 12, 14 providing structural sides of the core member 20 to support the fluid tubes 16 and fins 18 therebetween and further to provide structural interconnection of the core member 20 between the manifolds 12, 14.

In general, as a heated or charged fluid passes into the inlet 17 and through the fluid tubes 16, heat is absorbed therefrom by a cooling fluid, preferably, ambient air, flowing about the exterior of the fluid tubes 16. The cooling fluid exits from the assembly 10 at a higher temperature due to the exchange of heat with the fluid tubes 16 and fins 18. The charged fluid within the tubes 16 is thus cooled to a lower temperature and exits the assembly 10 by way of the outlet 19 in the lower manifold 14.

In general, the assembly 10 allows the fluid to circulate through the fluid tubes 16 and manifolds 12, 14 while cool air is passed by the fins 18 and about the fluid tubes 16 to cool the internal fluid. The cooling of the circulating fluid through the hollow fluid tubes 16 results in a large thermal expansion effect on the tubes 16 and fins 18 and manifolds 12, 14.

Each of the manifolds 12, 14 include distal ends 26 at the end of the longitudinal length of the manifolds 12, 14. The side support members 22 extend between the distal ends 26 of the manifolds 12, 14.

The side support members 22 may be comprised of brackets 28 of generally longitudinal U-shaped configuration. Such brackets 28 include a base 30 connected to the remainder of the core member 20 with side flanges 32 extending outwardly from the base 30. The brackets 28 include first and second ends 52, 54. The flanges 32 may allow for mounting of the heat exchanger assembly 10 within a vehicle. Alternatively, the side support members 22 may be comprised of a flat bracket or base 30 without the flanges 32. Various other configurations are allowed for the side support members 22, such as having a passageway therethrough to allow communication of the fluid between the manifolds 12, 14, in addition to fluid communication through the fluid tubes 16 as set forth in co-pending application Ser. No. 267,032 (our file P-316).

More specifically, the manifolds 12, 14 are comprised of a tank portion 34 and a header portion 38. The tank portion 34 generally includes openings therein providing the inlet 17 and/or outlet 19 of fluid to the heat exchanger assembly 10. Furthermore, the header portion 38 generally comprises a flat, longitudinal member having a plurality of apertures 46 therein for receiving the ends of the fluid tubes 16. In use, is it commonly known that the tank portion 34 is welded or soldered to the header portion 38 with the fluid tube 16 either soldered or braze sealed to the header portion 38 to provide a unitary, sealed assembly 10. Such construction is commonly known in the art.

The heat exchanger assembly 10 includes reinforcement straps 50 fixedly secured to and interconnecting the distal ends 26 of the manifolds 12, 14, and the longitudinal ends 52, 54 of the side support members 22 for allowing uninhibited thermal expansion of the manifolds 12, 14 and the core member 20 between the reinforcement straps 50 and for providing reinforcement of the joint or connection of the core member 20 and side support members 22 to the manifolds 12, 14. Specifically, the reinforcement straps 50 extend only adjacent and about the ends 26 of the manifolds 12, 14 and ends 52, 54 of the side support members 22 only an amount sufficient to provide and allow for a welding bond therebetween. The reinforcing straps 50 are welded to form a joint 70 against the distal ends 26 of the manifolds 12, 14 and are also welded to form a joint 72 against the base 30 of the brackets 28. This allows the majority of the distance extending between reinforcement straps 50, i.e., the core member 20 and the manifolds 12, 14, to experience thermal expansion while limiting the sheer stresses between the core member 20 and the manifolds 12, 14 by reinforcing the joints 70, 72 therebetween.

The reinforcement straps 50 are generally comprised of a structural metallic material, similar to the material used in side support member 22 or manifolds 12, 14. Included are four separate straps 50 positioned at each corner of the heat exchanger assembly 10 extending between the manifold 12, 14 and side support members 22 for reinforcing the bonded joints 70, 72.

Figure 3:
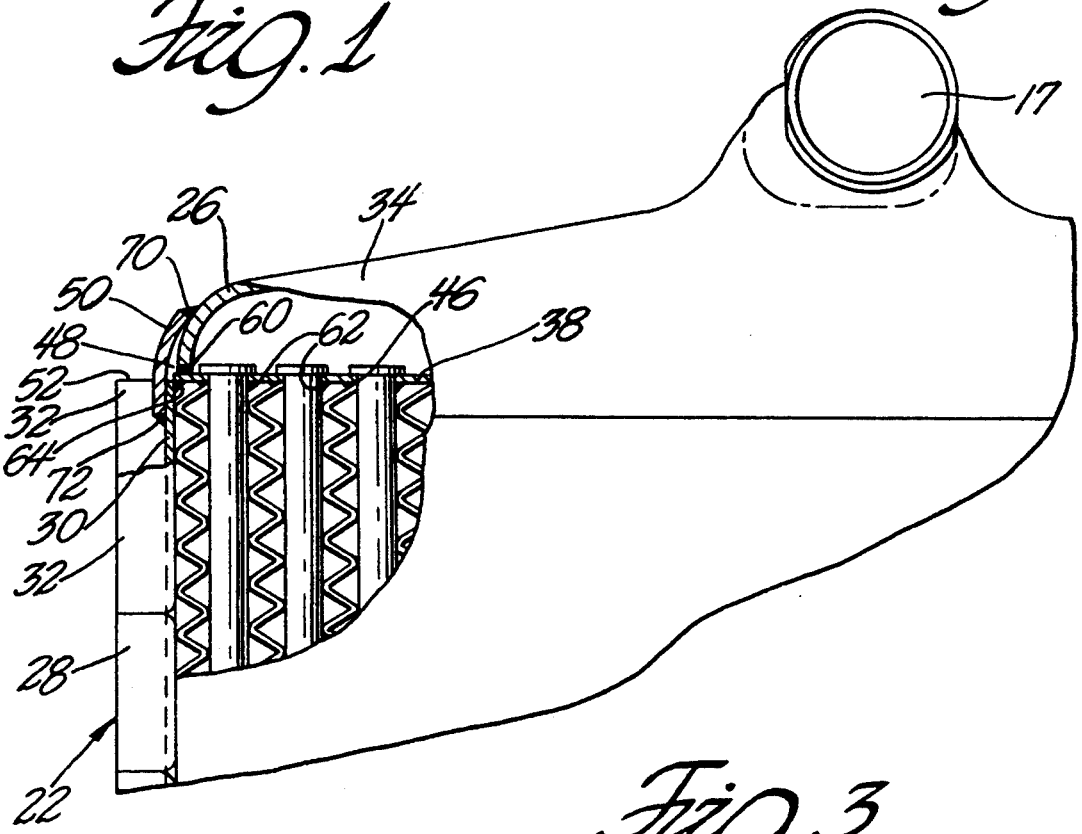
FIG. 3 is a fragmentary cross sectional view of the upper left hand corner of the subject invention shown in FIG. 1.

Also included is a method of making the heat exchanger assembly 10. First, the pair of tank portions 34 are formed with the distal ends 26, and the inlet/outlet openings 17, 19 are formed in the tanks 34. Thereafter, the header portion 38 is formed with the plurality of apertures 46 therethrough to receive the fluid tubes 16. The core member 20 is provided with the spaced parallel fluid tubes 16 and the air fins 18 extending therebetween, and the side support members 22 connected parallel with the fluid tubes 16 and at the outer sides of the core member 20 adjacent the outermost air fins 18. The core member 20 may be brazed sealed to seal the fluid tubes 16 and fins 18 and the side support members 22 to one another, with the side support members 22 welded to the outermost fins 18. The header portion 38 is thereafter assembled to the core member 20 by placing the ends of the fluid tubes 16 in the apertures 46 with the header spaced from the side support members 22. The tank portion 34 is assembled adjacent the header portion 38. The header portion 38 is sealed to the tank portion 34 at 60, and the header portion 38 is braze sealed or welded at 62 to the core member 20, and more particularly to the fluid tubes 16, by applying extreme heat to allow the braze material to flow and fill the joints therebetween. The header portion 38 is spaced from the side support members 22 as illustrated at 48 in FIG. 3 to allow thermal expansion of the header portion 38 during brazing of the fluid tubes 16 without creating undue stresses, i.e., stresses would occur with the header 38 welded to the side support members 22 since the members expand differently.

Thereafter, once the header portion 38, tank portion 40 and core member 20 are cooled, the header portion 38 retracts to its normal position. The header portion 38 is welded to the side support members 22 at 64. Thereafter, the reinforcement straps 50 are placed adjacent the distal ends 26 of the tank portions 40 of the manifolds 12, 14 and the ends of the side support members 22, and the weld seals 70, 72 are placed with the edges of the reinforcement straps 50 to the manifolds 12, 14 and side support members 22.

Upon flow through the assembly 10 of heated fluid, thermal expansion of the core member 20 and the manifolds 12, 14 occurs and changes as the cooling air is directed through the core member 20. The reinforcement straps 50 minimize shear stresses at the joints between the side members 22 and manifolds 12, 14 by providing a redundant and structural "joint".

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A heat exchanger assembly comprising:

a manifold (12) having an opening (17) for conveying fluid therethrough and including first and second distal ends (26);

a core member (20) connected to said manifold (12) between said first and second distal ends (26) for conveying fluid from said manifold (12) through said core member (20) for heat exchange;

said core member (20) including a plurality of fluid tubes (16) connected to said manifold (12) and extending therefrom for communicating fluid from said opening (17) of said manifold, a plurality of fins (18) connected between said fluid tubes (16) for enhancing heat exchange with fluid within said fluid tubes (16), and side support members (22) extending from said manifold (12) at said first and second distal ends (26) for supporting said fluid tubes (16) and said fins (18) therebetween, said side support members (22) each having a first end adjacent said distal ends of said manifold (12) said manifold (12) including a tank portion (34) having said opening (17) and a header portion (38) connected to form said manifold (12), said header portion (38) including a plurality of apertures (46) therein for receiving said fluid tubes (16), said header portion (38) being fixedly connected to said side support members (22) and fixedly connected to said fluid tubes (16);

reinforcement members (50) fixedly secured to and separately interconnecting said distal ends (26) of said manifold (12) to said first ends of said side support members (22) for allowing uninhibited thermal expansion of said manifold (12) and said core member (20) between said reinforcement members (50) and for providing reinforcement of connection of said side support member (22) to said manifold (12).

2. An assembly as set forth in claim 1 further characterized by said side support members (22) each comprising a bracket (28) having a base (30) welded to said core member (20) and a pair of flanges (32) extending outwardly from said base (30) for mounting of said assembly in a vehicle, said bracket (28) including said first end welded to said reinforcement member (50).

3. An assembly as set forth in claim 1 further characterized by including a second manifolds (14) with said core member (20) extending between said manifolds (12, 14) to provide fluid communication between said manifolds (12, 14) and through said core member (20), said manifolds (12, 14) each including distal ends welded to one of four of said reinforcement members (50).

4. A heat exchanger assembly comprising:

a manifold (12) having an opening (17) for conveying fluid therethrough and including first and second distal ends (26);

a core member (20) connected to said manifold (12) between said first and second distal ends (26) for conveying fluid from said manifold (12) through said core member (20) for heat exchange;

said core member (20) including a plurality of fluid tubes (16) connected to said manifold (12) and extending therefrom for communicating fluid from said opening (17) of said manifold, and at least one side support member (22) extending from said manifold (12) at said first distal end (26) for supporting said fluid tubes (16) therebetween, said side support member (22) having a first end adjacent said distal end of said manifold (12); said manifold (12) including a tank portion (34) and a header portion (38) connected to form said manifold (12), said header portion (38) including a plurality of apertures (46) therein for receiving said fluid tubes (16), said header portion (38) being fixedly connected to said side support member (22);

reinforcement member (50) fixedly secured to and separately interconnecting said distal end (26) of said manifold (12) to said first end of said side support member (22) for providing reinforcement of connection of said side support member (22) to said manifold.

* * * * *